US006665514B1

(12) United States Patent
Miyazaki

(10) Patent No.: US 6,665,514 B1
(45) Date of Patent: Dec. 16, 2003

(54) FIXING APPARATUS AND METHOD THAT FEEDS A CLEANING MEMBER BASED ON PIXEL COUNT

(75) Inventor: Yasunari Miyazaki, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/156,803

(22) Filed: May 30, 2002

(51) Int. Cl.[7] ..... G03G 15/20
(52) U.S. Cl. ..... 399/327
(58) Field of Search ..... 399/33, 67, 326, 399/327

(56) References Cited

U.S. PATENT DOCUMENTS 6,016,409 A * 1/2000 Beard et al. ..... 399/33

FOREIGN PATENT DOCUMENTS

JP 10-171289 6/1998

* cited by examiner

*Primary Examiner*—William J. Royer
(74) *Attorney, Agent, or Firm*—Foley & Lardner

(57) ABSTRACT

A fixing apparatus includes a fixing device which fixes a developer image onto a transferred body, by passing the transferred body, between a first roller and a second roller. A cleaning member, provided in contact with the first roller, removes the developer image adhered onto the first roller at the time of fixing the developer image. A feeding device feeds the cleaning member by a predetermined amount to change a contact position thereof to the first roller. A counter counts the number of pixels of the image. A control device operates the feeding device to feed the cleaning member on the basis of the number of pixels counted by the counter.

8 Claims, 4 Drawing Sheets

FIXING APPARATUS AND METHOD THAT FEEDS A CLEANING MEMBER BASED ON PIXEL COUNT

BACKGROUND OF THE INVENTION

The present invention relates to a fixing apparatus and a fixing method applied to a color electronic copying machine, a printer, and a facsimile.

Fixing apparatuses of this kind include those comprising a heating roller and a pressure roller in pressure contact with the heating roller. In such fixing apparatuses, a toner image is melted and fixed on paper, by passing the paper onto which the toner image has been transferred through a nip part formed between the heating roller and the pressure roller, in a direction in which the toner image contacts the heating roller.

In the meantime, at the time of the above fixing, there are the cases where toner in the toner image transfers onto the heating roller due to unsatisfactory fixing. The apparatuses are structured such that the transferred toner is removed by being cleaned off by a cleaning member.

The cleaning member is positioned between a feeding roller and a winding roller, and an almost central portion of the cleaning member is pressed by a pressing roller and thereby is in pressure contact with the heating roller. The cleaning member is structured to be periodically fed by the feeding roller such that its new surface contacts the heating roller.

However, if the cleaning member is periodically fed, in the case of printing (copying) an image of a high printing rate, for example, a cleaning fault occurs, which causes an offset.

Further, conversely, in the case of printing (copying) an image of a low printing rate, the cleaning member is fed although it is still usable, which results in shortening the life of the cleaning member.

Therefore, it has been considered to control feeding of a cleaning member by determining the amount of spots on the cleaning member on the basis of a rate such as the printing rate, instead of periodically feeding the cleaning member.

However, in such a case, the amount of spots on the cleaning member are averaged and the averaged spot amount is determined, thus this method cannot deal with local spots and results in cleaning faults such as cleaning spots.

BRIEF SUMMARY OF THE INVENTION

The present invention has been made in consideration of the above circumstances, and is aimed at providing a fixing apparatus and a fixing method which can reduce unnecessary use of a cleaning member and extend its life, and can obtain an optimum cleaning performance.

A fixing apparatus according to a first embodiment of the invention comprises a fixing device having a first roller and a second roller in pressure contact with the first roller, the fixing device fixing a developer image corresponding to an image onto a transferred medium by passing the transferred medium, onto which the developer image has been transferred, between the first roller and the second roller, in a direction in which the developer image contacts the first roller; a cleaning member which is in contact with the first roller, and removes the developer image adhered to the first roller at the time of fixing the developer image; a feeding device which feeds the cleaning member by a predetermined amount to change a contact position thereof to the first roller; a counter which counts the number of pixels of the image; and a control device which operates the feeding device to feed the cleaning member, on the basis of the number of pixels counted by the counter.

A fixing apparatus according to a second embodiment of the invention comprises a fixing device having a first roller and a second roller in pressure contact with the first roller, the fixing device fixing a developer image corresponding to an image onto a transferred medium by passing the transferred medium, onto which the developer image has been transferred, between the first roller and the second roller, in a direction in which the developer image contacts the first roller; a cleaning member which is in contact with the first roller, and removes the developer image adhered to the first roller at the time of fixing the developer image; a feeding device which feeds the cleaning member by a predetermined amount to change a contact position thereof to the first roller; a counter device which counts, by respective counters, the numbers of pixels of a plurality of regions, the regions being obtained by dividing a region of the image, whose number of pixels is to be counted, in an axial direction of the first roller; and a control device which operates the feeding device to feed the cleaning member, on the basis of counting of a predetermined number of pixels by any one of the counters of the counter device.

A fixing method according to a third embodiment of the invention comprises having a first roller and a second roller in pressure contact with the first roller, fixing a developer image corresponding to an image onto a transferred medium by passing the transferred medium, onto which the developer image has been transferred, between the first roller and the second roller, in a direction in which the developer image contacts the first roller; removing, by a cleaning member, the developer image which has contacted the first roller and adhered to the first roller at the time of fixing the developer image; feeding the cleaning member by a feeding device by a predetermined amount to change a contact position thereof to the first roller; counting the number of pixels of the image by a counter; and operating the feeding device to feed the cleaning member, on the basis of the number of pixels counted by the counter.

A fixing method according to a fourth embodiment of the invention comprises having a first roller and a second roller in pressure contact with the first roller, fixing a developer image corresponding to an image onto a transferred medium by passing the transferred medium, onto which the developer image has been transferred, between the first roller and the second roller, in a direction in which the developer image contacts the first roller; removing, by a cleaning member, the developer image which has contacted the first roller and adhered to the first roller at the time of fixing the developer image; feeding the cleaning member by a feeding device by a predetermined amount to change a contact position thereof to the first roller; counting, by respective counters, the numbers of pixels of a plurality of regions, the regions being obtained by dividing a region of the image, whose number of pixels is to be counted, in an axial direction of the first roller; and operating the feeding device to feed the cleaning member, on the basis of counting of a predetermined number of pixels by any one of the counters.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
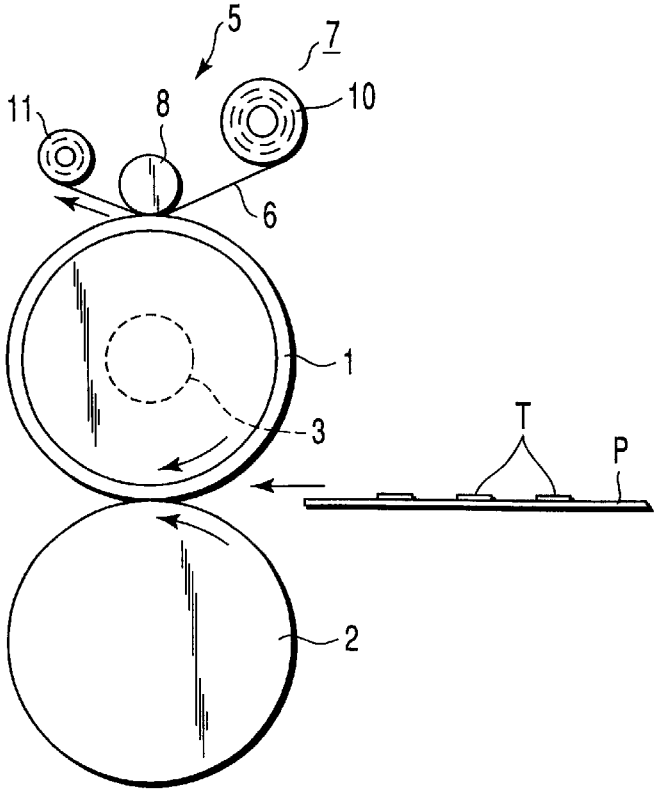
FIG. 1 is a diagram showing a structure of a fixing apparatus which is a first embodiment of the present invention.

The present invention will now be described in detail with reference to embodiments shown in the drawings.

FIG. 1 is a schematic diagram showing a structure of a fixing apparatus which is an embodiment of the present invention.

The fixing apparatus comprises a heating roller 1 serving as a first roller, and a pressure roller 2 serving as a second roller being in pressure contact with a lower portion side of the heating roller 1. A heater 3 is provided inside the heating roller 1.

Further, a cleaning device 5 is provided on an upper portion side of the heating roller 1. The cleaning device 5 comprises a web-like cleaning member 6, and a feeding device 7 which feeds the cleaning member 6. The feeding device 7 comprises a feeding roller 10 which feeds the cleaning member 6, and a winding roller 11 which winds the cleaning member 6 fed by the feeding roller 10. An almost central portion of the cleaning member 6 is pressed by a pressing roller 8 onto an upper surface portion of the heating roller 1.

Paper P, serving as a transferred body onto which a toner image T as a developer image corresponding to an image has been transferred, is carried as shown by an arrow and fed between the heating roller 1 and the pressure roller 2, and passes therebetween in a direction in which the toner image T contacts the heating roller 1. Thereby, the toner image T is heated and pressed, and thereby melted and fixed onto the paper P.

At the time of fixing, there are cases where toner of the toner image T transfers onto the heating roller 1. If a fixing operation is continued in the state where toner has been transferred onto the heating roller 1, the toner on the heating roller 1 adheres to the following paper P and soils the paper P.

Figure 2:
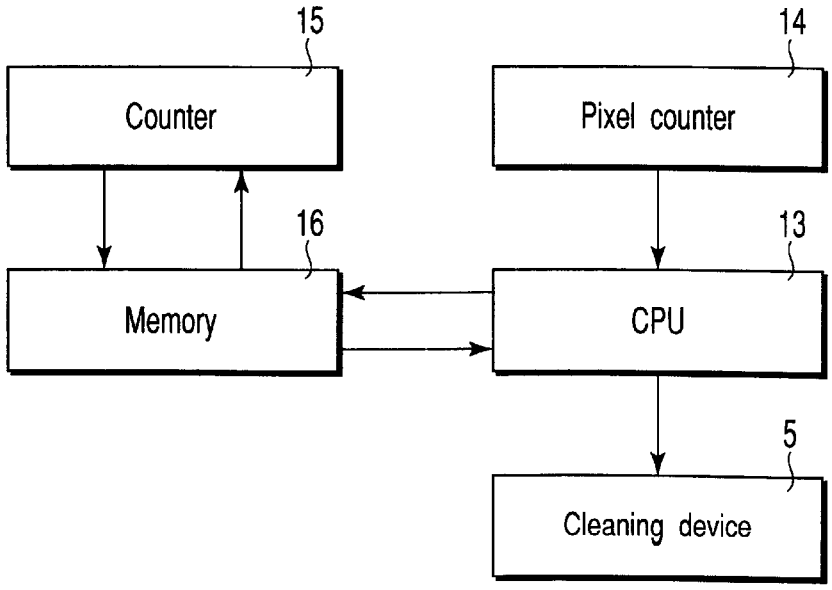
FIG. 2 is a block diagram showing a drive control system of a cleaning device of the fixing apparatus.

Therefore, the cleaning member 6 removes such toner adhered to the heating roller 1. The cleaning member 6 is fed when it becomes soiled, and a new surface thereof is brought into contact with the heating roller 1 to clean it. FIG. 2 is a block diagram showing a drive control system of the cleaning device 5.

The cleaning device 5 is connected to a CPU 13 serving as a control device, with a control circuit interposed therebetween. Further, a pixel counter 14 which counts pixels of an image of a document is connected to the CPU 13 (which is connected to a memory 16) with a signal transmitting circuit interposed therebetween. Furthermore, a counter 15 stores the number of pixels counted by the pixel counter 14.

Figure 5:
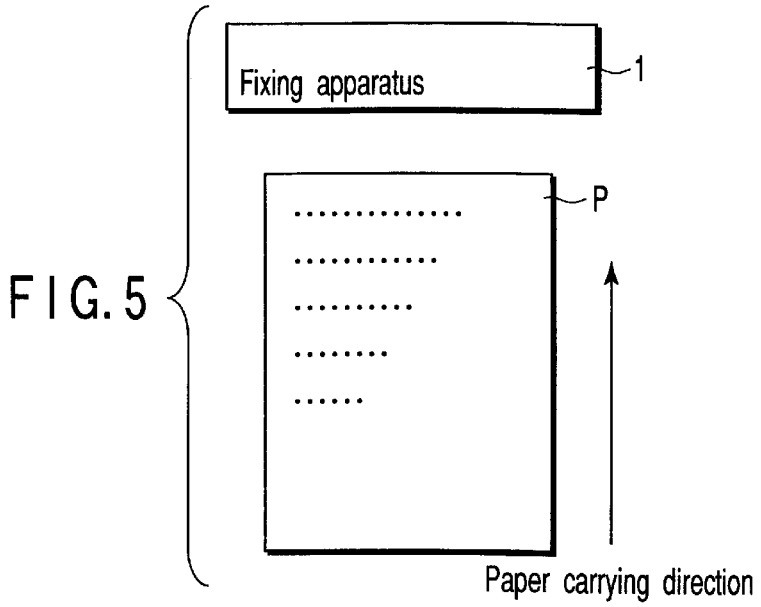
FIG. 5 is a diagram showing an operation of counting pixels.

The pixel counter 14 counts pixels in order from an upper left pixel (a line) on the front side of the paper P inserted into the fixing apparatus as shown in FIG. 5, for example. After it has counted a line of Specific examples of methods of detecting and counting pixels are: a method in which pixels of a document are read by a CCD and the read pixels are counted, or a method in which image data from a personal computer is expanded in the bitmap format and its pixels are counted.

Figure 3:
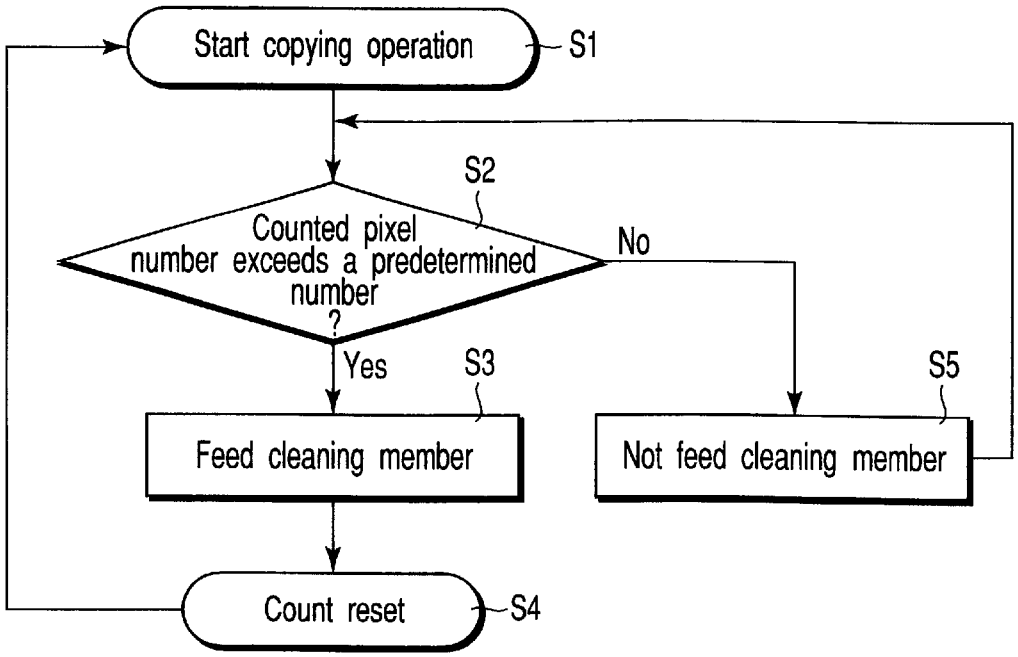
FIG. 3 is a flow chart showing a cleaning operation.

Next, the cleaning operation of the cleaning device 5 will be explained with reference to the flow chart shown in FIG. 3.

When a copying operation is started (step S1), the pixel counter 14 counts the number of pixels of the image, and the counted pixel number is stored in the counter 15 by the CPU 13. Thereafter, it is determined whether the counted number stored in the counter 15 has exceeded a predetermined number (step S2). If it is determined that the pixel number exceeds the predetermined number, the feeding roller 10 and the winding roller 11 are rotated and the cleaning member 6 is fed (step S3). Thereby, a new surface of the cleaning member 6 is brought into contact with the heating roller 1 to perform cleaning. Thereafter, the counter 15 is reset (step S4). After this resetting operation, the pixel counter 14 counts the number of the following pixels of the image, and if the number of the counted pixels exceeds the predetermined number, the same operation as described above is repeated and cleaning is performed.

Further, if the number of counted pixels is determined as not exceeding the predetermined number in step S2, the cleaning member 6 is not fed (step S5).

Figure 4:
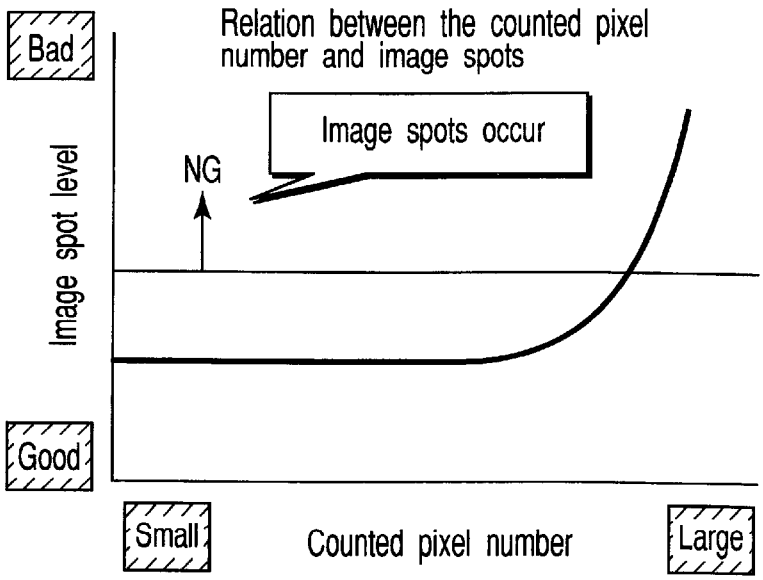
FIG. 4 is a graph showing a relation between a counted pixel number and image spots.

FIG. 4 is a graph showing the relation between the counted pixel number and image spots. The graph shows that image spots occur when the counted pixel number exceeds a predetermined number.

As described above, if the counted pixel number exceeds a predetermined number, the cleaning member 6 is fed and its new surface is brought into contact with the heating roller 1 to clean it, and thus it is possible to perform optimum cleaning, in comparison with an apparatus which controls feeding of the cleaning member 6 according to the printing rate. Therefore, it is possible to improve the life of the cleaning member 6 and improve the stability of the image.

FIGS. 6 to 9 show a second embodiment of the present invention.

Like reference numerals are assigned to like elements shown in the first embodiment, and their explanations are omitted.

Figure 6:
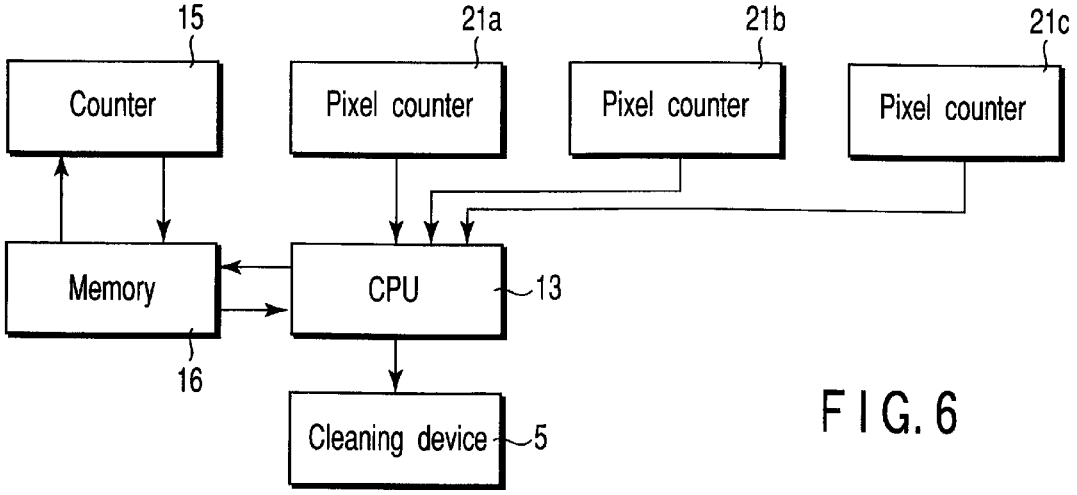
FIG. 6 is a block diagram showing a drive control system of a cleaning device in a second embodiment of the present invention.
Figure 7:
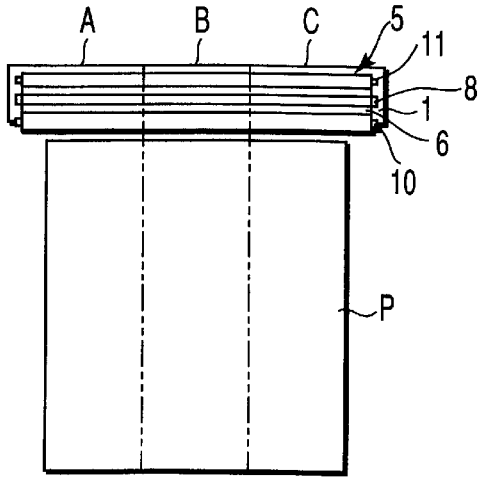
FIG. 7 is a diagram showing divided regions in a heating roller.

The second embodiment comprises pixel counters 21*a* to 21*c* as shown in FIG. 6. The counters 21*a* to 21*c* separately count the pixel numbers of respective divided image regions. The divided image regions correspond to divided regions A, B, and C which are obtained by dividing the heating roller 1 into plural regions in the axial direction of the heating roller 1 as shown in FIG. 7.

Figure 8:
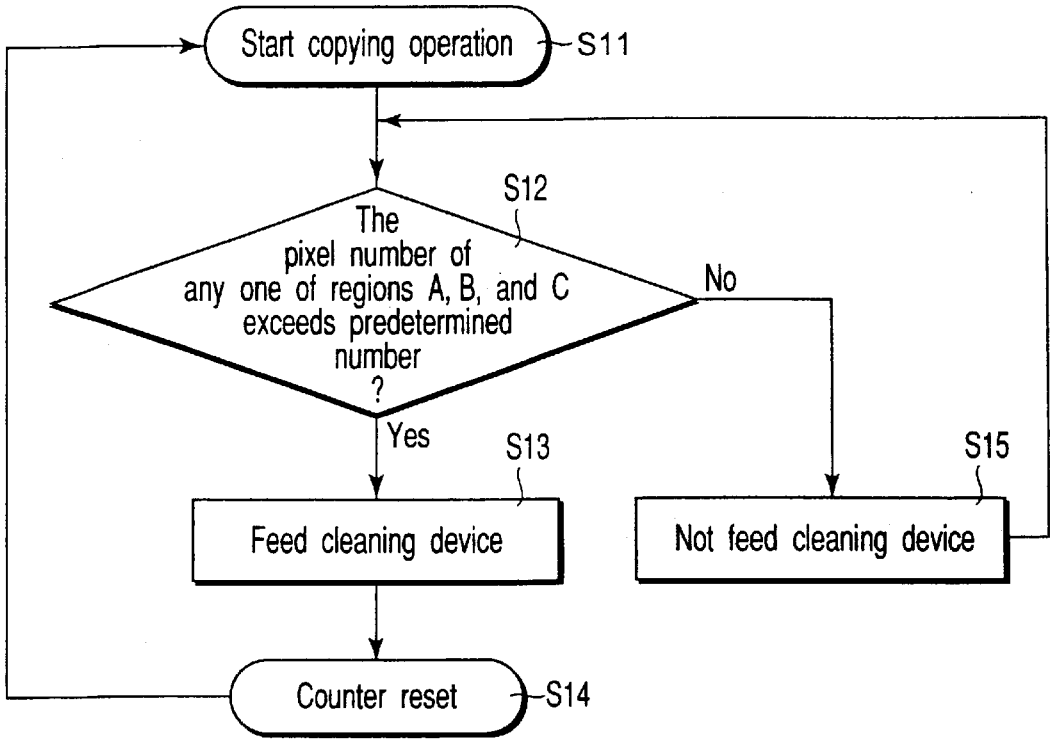
FIG. 8 is a flow chart showing a cleaning operation.
Figure 9:
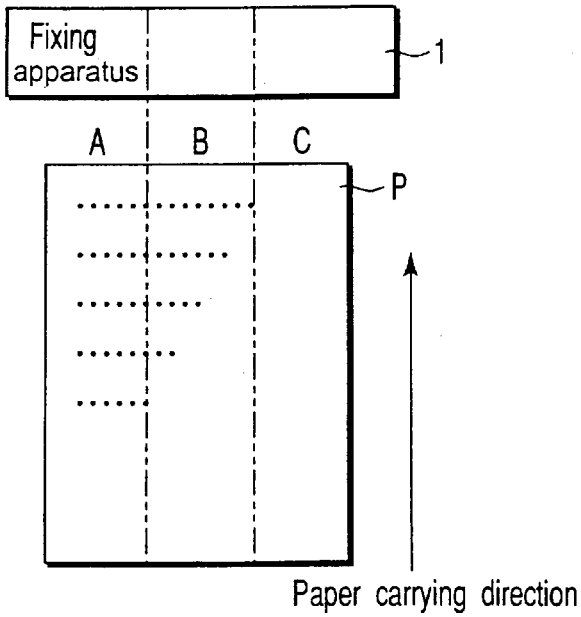
FIG. 9 is a diagram showing an operation of counting pixels.

Next, a cleaning operation of the cleaning device 5 will be described with reference to the flow chart of FIG. 8.

When a copying operation is started (step S11), the plurality of pixel counters 21*a* to 21*c* count the pixel numbers of respective image regions, and the counted pixel numbers are individually stored in the counter 15 by the CPU 13. Thereafter, it is determined whether the counted number of any one of the regions stored in the counter 15 has exceeded a predetermined number (step S12). If it is determined that the counted number of any one of the regions exceeds the predetermined number, the feeding roller 10 and the winding roller 11 are rotated and the cleaning member 6 is fed (step S13). Thereby, a new surface of the cleaning member 6 is brought into contact with the heating roller 1 to perform cleaning. Thereafter, all the data stored in the counter 15 is reset (step S14). After the resetting operation, the pixel counters 21*a* to 21*c* count the numbers of the following pixels in the respective regions of the image, and when it is determined that any one of the counted numbers exceeds the predetermined number, the same operations as described above are repeated, and cleaning is performed.

Further, if none of the counted numbers exceed the predetermined number, the cleaning member 6 is not fed (step S15).

The second embodiment produces advantageous effects similar to those of the first embodiment.

Further, in the second embodiment, the pixel counters 21*a* to 21*c* are provided for respective divided regions A, B and C divided in the axial direction of the heating roller 1. Therefore, even if one divided region is more soiled than the other regions, the cleaning member 6 can be fed at a proper timing. This is particularly effective where an image is uneven in the axial direction of the heating roller 1.

Further, although in the above embodiments the first roller is the heating roller 1 and the second roller is the pressure roller 2, the present invention is not limited to this, and the first roller may be the pressure roller 2 and the second roller may be the heating roller 1 as a matter of course.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

a fixing device having a first roller and a second roller in pressure contact with the first roller, the fixing device fixing a developer image corresponding to an image onto a transferred medium by passing the transferred medium, onto which the developer image has been transferred, between the first roller and the second roller, in a direction in which the developer image contacts the first roller;

a cleaning member which is in contact with the first roller, and removes the developer image adhered to the first roller at the time of fixing the developer image;

a feeding device which feeds the cleaning member by a predetermined amount to change a contact position thereof to the first roller;

a counter which counts the number of pixels of the image; and a control device which operates the feeding device to feed the cleaning member, on the basis of the number of pixels counted by the counter.

2. A fixing apparatus according to claim 1, the first roller being a heating roller, and the second roller being a pressure roller.

3. A fixing apparatus according to claim 1, the feeding device comprising a feeding roller which feeds the cleaning member, a winding roller which winds the cleaning member fed by the feeding roller, and a pressing member which presses the cleaning member onto the first roller.

4. A fixing apparatus comprising:

a fixing device having a first roller and a second roller in pressure contact with the first roller, the fixing device fixing a developer image corresponding to an image onto a transferred medium by passing the transferred medium, onto which the developer image has been transferred, between the first roller and the second roller, in a direction in which the developer image contacts the first roller;

a cleaning member which is in contact with the first roller, and removes the developer image adhered to the first roller at the time of fixing the developer image;

a feeding device which feeds the cleaning member by a predetermined amount to change a contact position thereof to the first roller;

a counter device which counts, by respective counters, the numbers of pixels of a plurality of regions, the regions being obtained by dividing a region of the image, whose number of pixels is to be counted, in an axial direction of the first roller; and a control device which operates the feeding device to feed the cleaning member, on the basis of counting of a predetermined number of pixels by any one of the counters of the counter device.

5. A fixing apparatus according to claim 4, the first roller being a heating roller, and the second roller being a pressure roller.

6. A fixing apparatus according to claim 4, the feeding device comprising a feeding roller which feeds the cleaning member, a winding roller which winds the cleaning member fed by the feeding roller, and a pressing member which presses the cleaning member onto the first roller.

7. A fixing method comprising:

having a first roller and a second roller in pressure contact with the first roller, fixing a developer image corresponding to an image onto a transferred medium by passing the transferred medium, onto which the developer image has been transferred, between the first roller and the second roller, in a direction in which the developer image contacts the first roller;

removing, by a cleaning member, the developer image which has contacted the first roller and adhered to the first roller at the time of fixing the developer image;

feeding the cleaning member by a feeding device by a predetermined amount to change a contact position thereof to the first roller;

counting the number of pixels of the image by a counter; and operating the feeding device to feed the cleaning member, on the basis of the number of pixels counted by the counter.

8. A fixing method comprising:

having a first roller and a second roller in pressure contact with the first roller, fixing a developer image corresponding to an image onto a transferred medium by passing the transferred medium, onto which the developer image has been transferred, between the first roller and the second roller, in a direction in which the developer image contacts the first roller;

removing, by a cleaning member, the developer image which has contacted the first roller and adhered to the first roller at the time of fixing the developer image;

feeding the cleaning member by a feeding device by a predetermined amount to change a contact position thereof to the first roller;

counting, by respective counters, the numbers of pixels of a plurality of regions, the regions being obtained by dividing a region of the image, whose number of pixels is to be counted, in an axial direction of the first roller; and operating the feeding device to feed the cleaning member, on the basis of counting of a predetermined number of pixels by any one of the counters.

* * * * *